US007044407B2

(12) United States Patent
Fischer et al.

(10) Patent No.: US 7,044,407 B2
(45) Date of Patent: May 16, 2006

(54) FLUID DOSING DEVICE WITH A THROTTLE POINT

(75) Inventors: Bernhard Fischer, Toeging A. Inn (DE); Bernhard Gottlieb, München (DE); Andreas Kappel, Brunnthal (DE); Randolf Mock, Hohenbrunn (DE); Enrico Ulivieri, München (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/428,613

(22) Filed: May 2, 2003

(65) Prior Publication Data

US 2004/0004139 A1 Jan. 8, 2004

Related U.S. Application Data

(63) Continuation of application No. PCT/DE01/04089, filed on Oct. 29, 2001.

(30) Foreign Application Priority Data

Nov. 2, 2000 (DE) ..... 100 54 182
Dec. 7, 2000 (DE) ..... 100 60 939

(51) Int. Cl.
*F02M 61/08* (2006.01)

(52) U.S. Cl. ..... 239/533.7; 239/453; 239/533.1; 239/533.9; 239/584; 251/335.3; 251/129.17

(58) Field of Classification Search ..... 239/88, 239/453, 533.1, 533.2, 533.3, 584, 533.7, 239/533.9; 251/129.17, 282, 335.1–335.3
See application file for complete search history.

(56) References Cited

U.S. PATENT DOCUMENTS

| | | | | |
|---|---|---|---|---|
| 2,613,998 | A * | 10/1952 | Noon et al. | 239/533.2 |
| 3,282,512 | A * | 11/1966 | Bluhm et al. | 239/584 |
| 4,803,393 | A * | 2/1989 | Takahashi | 239/533.1 |
| 5,205,492 | A * | 4/1993 | Khinchuk | 239/533.9 |
| 6,311,950 | B1 * | 11/2001 | Kappel et al. | 251/335.3 |
| 6,676,030 | B1 * | 1/2004 | Lorraine et al. | 239/533.3 |

FOREIGN PATENT DOCUMENTS

| | | |
|---|---|---|
| DE | DD 81 262 | 3/1970 |
| DE | 199 58 704 A1 | 12/1999 |
| DE | 100 07 733 A1 | 2/2000 |
| EP | 1 046 809 A2 | 4/2000 |

* cited by examiner

*Primary Examiner*—Steven J. Ganey

(74) *Attorney, Agent, or Firm*—Baker Botts, L.L.P.

(57) ABSTRACT

A fluid dosing device for a pressurized liquid is disclosed, which comprises a chamber (35) which is supplied with pressurized liquid by means of a liquid supply line (17, 19); a valve needle (9) which is guided through the chamber (35), the first end section of said valve needle being able to be lifted and the second end section thereof forming a valve in conjunction with a valve seat disposed on the housing (3). Metal bellows (33) are provided as a leadthrough element for the first end section of the valve needle (9). The metal bellows seal the chamber in said region in a tight manner. A throttle point (37, 39) is provided between the valve needle (9) and the inner wall of the chamber between the metal bellows (33) and the mouth (18) of the liquid supply line (17) leading into the chamber.

17 Claims, 3 Drawing Sheets

Section B-B

Section A-A

FLUID DOSING DEVICE WITH A THROTTLE POINT

CROSS REFERENCE TO RELATED APPLICATION

This application is a continuation of copending International Application No. PCT/DE01/04089 filed Oct. 29, 2001, which designates the United States, and claims priority to German application number 10060939.2 filed Dec. 7, 2000, and German application number 10054182.8 filed Nov. 2, 2000.

BACKGROUND OF THE INVENTION

The present invention relates to a fluid dosing device for a pressurized liquid with a chamber arranged in a housing, which is supplied with pressurized fluid by means of a liquid supply line and with a valve needle, which is guided through the chamber, the first end section of said valve needle being able to be lifted outside the chamber and the second end section thereof forming a valve which is connected to the housing, in conjunction with a valve seat provided on the housing.

Various sealing or leadthrough elements for fluid dosing devices are known in the prior art. In cases where pressurized fuel at a pressure of up to 300 bar for example and a working temperature of −40° C. to +150° C. is dosed, special requirements are set for mass-produced products. In particular exacting requirements must be complied with in respect of embrittlement, wear and reliability. The fatigue strength of the O-ring seals used up to now does not comply with the above requirements. Diaphragm seals such as for example metal beads, etc. can also be used in place of O-ring seals. When such diaphragms are used as the leadthrough element for a valve needle through a pressurized chamber however the requirements relating to high axial flexibility are not complied with when the compression strength is adequate.

The valve needle can also continue to be effected by means of a clearance fit of the needle in a cylindrical hole in the housing as in diesel injectors. A disadvantage of this is the unavoidable leakage along the needle leadthrough. The higher level of hydraulic loss also reduces the overall efficiency of the motor.

SUMMARY OF THE INVENTION

The object of the present invention is to provide a tight leadthrough for the valve needle in a generic fluid dosing device in particular, which achieves the required fatigue strength.

According to the invention this is achieved with a fluid dosing device for a pressurized fluid comprising a chamber located in a housing, to which the pressurized liquid is guided through a liquid supply line, a valve needle guided through the chamber, wherein a stroke can be applied to a first end section thereof outside of the chamber and the second end section thereof forming, in conjunction with a valve seat disposed on the housing, a valve which is connected to the chamber, and a flexible leadthrough element being provided for the first end section of the valve needle from the chamber outwards, which seals the chamber in said region in a tight manner, wherein at least one throttle point is provided circumferentially between the valve needle and the inner wall of the chamber in the section of the chamber between the leadthrough element and the mouth of the liquid supply line into the chamber, with a gap representing the throttle point being a few μm wide.

The object can also be achieved by a fluid dosing device for a pressurized fluid comprising a chamber located in a housing, to which the pressurized liquid is guided through a liquid supply line, a valve needle guided through the chamber having a first end section outside of the chamber and a second end section which forms in conjunction with a valve seat disposed on the housing a valve which is connected to the chamber, and a flexible leadthrough element being provided for the first end section of the valve needle, which seals the chamber in said region in a tight manner, wherein at least one throttle point is provided circumferentially between the valve needle and the inner wall of the chamber in the section of the chamber between the leadthrough element and the mouth of the liquid supply line into the chamber, wherein the throttle point is formed by a gap having a width of a few μm.

The fluid dosing device may further comprise bellows, in particular metal bellows, as the leadthrough element. The metal bellows may have a wall thickness of 25 to 500 μm. The leadthrough element may be attached to an assembly sleeve, in particular by means of a welded connection. The throttle point may be created in the chamber by the assembly sleeve. An upper valve needle guide can be provided and the throttle point can be created in the chamber by the upper valve needle guide. The free cross-section between the valve needle and the inner wall of the chamber can be changed abruptly in the region of the throttle point. The gap in the region of the throttle point may be a few μm wide. Fuel can be used as the liquid and the fuel pressure may be in the range of between 1 and 500 bar. The diameter of a clearance fit of the valve needle can correspond to a hydraulically effective diameter of the metal bellows.

According to the invention, at least one throttle point is arranged circumferentially between the valve needle and the inner wall of the chamber in the chamber section between the leadthrough element and the mouth of the liquid supply line into the chamber. Measurements have shown that metal bellows designed as leadthrough elements for use in high pressure injection valves, for example in vehicle engineering, can withstand static pressure loads up to approx. 200 bar without any problems. A much higher compression resistance can also be achieved by increasing the wall thickness. Further tests on moving metal bellows seals also showed that metal bellows subjected to high pressure do not suffer degradation during execution of an axial movement of up to 50 μm with a frequency of 50 Hz typical of the injection valves. Using metal bellows thus means that the fuel chamber is hermetically sealed with adequate compression strength.

It was however surprisingly established that the metal bellows fail after approx. 10 min when used operationally in a high-pressure injection valve at a static pressure load of 200 bar. The reason for this is that during the opening and closing of the injection valve or injector, pressure waves are triggered in the fuel chamber of the injector, which fluctuate about the basic pressure set with an amplitude of up to ±50% of the fuel pressure set and a frequency of approx. 500 Hz–10 Hz, typically in the range of approx. 500–800 Hz, depending on the opening and closing times of the injector. The occurrence of such pressure oscillations results in failure of the metal bellows seal when pressure waves are triggered. The throttle points provided according to the invention protect the metal bellows from the destructive effect of these pressure oscillations.

To summarize, therefore, according to the invention adequate tightness of the fuel chamber is achieved by means of the metal bellows, with the metal bellows seal being protected from pressure waves occurring during operation, thereby achieving a typical fatigue strength for vehicle engineering of at least $10^9$ load cycles (approx. 2000 operating hours).

Advantageously the metal bellows have a wall thickness of 25 to 500 μm. These low wall strength levels have proven totally adequate at high pressures of for example 300 bar. Tests have shown that a configuration of the metal bellows in the form of semi-circular segments ranged adjacent to each other—visible in the longitudinal cross-section—offers particular advantages. These semi-circular segments can be supplemented by intermediate straight sections.

According to a preferred embodiment the flexible leadthrough element is attached to an assembly sleeve, in particular by means of a welded connection. This is particularly favorable for manufacturing purposes, as metal bellows in particular can only be attached directly to the valve needle at relatively high cost. The assembly sleeve provides an element by means of which a precisely dimensioned throttle point can be achieved in the fuel chamber in a simple manner.

In order to be able to create a suitable throttle point in the fuel chamber, an upper guide sleeve is configured as an alternative to or in addition to the appropriately dimensioned assembly sleeve, so that a narrow and as long as possible a clearance fit is achieved through this valve needle guide. As the upper valve needle guide is provided anyway in the fuel injector, additional components can be dispensed with.

If both the assembly sleeve and upper valve needle guide throttle points are created at the same time in the fluid dosing device, the respective throttle gaps can be larger and/or shorter in the axial direction, without having a negative impact on the protective effect of the throttle points for the metal bellows. Also fitting errors are avoided, which may result in the valve needle jamming. However this also applies if the throttle point created by the assembly sleeves is dispensed with, with the throttle point created by the upper guide sleeve being designed accordingly.

In order to prevent or significantly restrict propagation of the pressure waves in the fuel chamber in the direction of the metal bellows, the free cross-section between the valve needle and the inner wall of the chamber is changed abruptly in the region of the throttle point. This results in the required reflection of the pressure waves off the section of the inner wall of the chamber extending perpendicular to the direction of propagation of the pressure waves.

The gap width of the throttle point is selected on the basis of the position of the throttle point in the fuel chamber and the length of the throttle gap taking into account the static and dynamic pressure conditions. A few μm have proved to be a typical value for the gap width of the throttle point in the fuel chamber of a high-pressure fuel injector.

BRIEF DESCRIPTION OF THE DRAWINGS

Four embodiments of the fluid dosing device according to the invention are described below using diagrammatic representations. These show.

DETAILED DESCRIPTION OF THE PREFERRED EMBODIMENTS

Figure 1A:
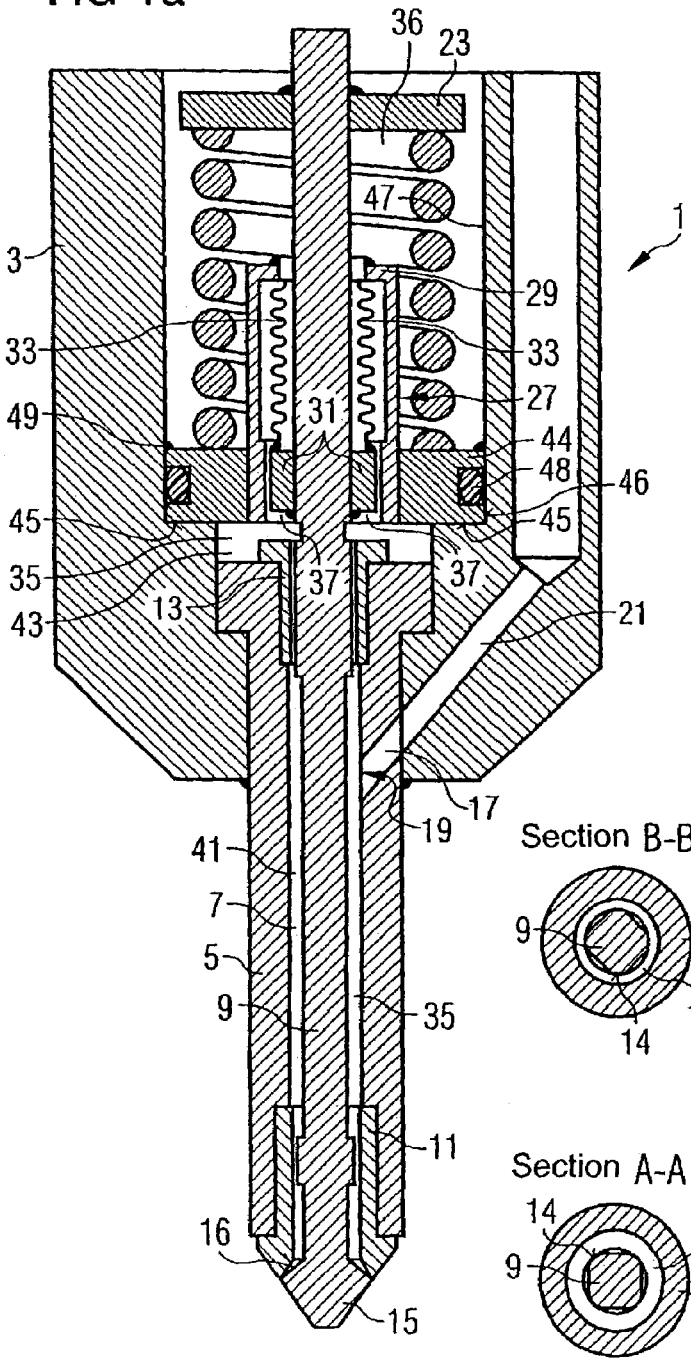
FIG. 1*a* a longitudinal section of the first embodiment of the fluid dosing device, FIG. 1*b* two cross-sectional representations along the lines A—A and B—B in FIG. 1*a*, FIG. 2 a longitudinal section of the second embodiment, FIG. 3*a* a longitudinal section of the third embodiment of the fluid dosing device and FIG. 3*b* two cross-sectional representations along the lines A—A and B—B in FIG. 3*a*.

The actuator unit generally known per se is not shown for the purposes of simplicity in an injection value 1 shown diagrammatically in FIGS. 1*a, b* according to a first embodiment. The fuel injection valve 1 has a housing 3 with a central hole, in which a valve body 5 is mounted. A valve needle 9 is guided in an axially displaceable manner in a valve body hole 7 of the valve body. To this end a lower or front and upper or rear guide sleeve 11, 13 is attached to the valve body 5 in the upper and lower end sections of the valve body hole 7 and these guide sleeves create corresponding valve needle guides. The resulting narrow points are designed so that they do not impede or throttle a flow of liquid when the valve 1 opens and closes. To this end the valve needle 9 has a circumferentially projecting, rounded square cross-section according to FIGS. 1*a, b* (section A—A and section B—B) at both the level of the lower and upper guide sleeves 11, 13 or the two valve needle guides. The valve needle 9 with the rounded edge areas 14 is inserted into the two guide sleeves 11, 13 with a clearance of less than 2 μm. The free gap between the four side surfaces of the square of the valve needle 9 and the cylindrical inner wall of the guide sleeves 11, 13 is configured so that it is significantly larger to avoid any throttle effect.

In the basic state a valve disk 15 configured at the front end section of the valve needle 9 seals a valve seat 16 on the valve body 5. A valve body fuel supply line 17 is provided in the valve body and this opens into the valve body hole 7 with a mouth 19 between the lower and upper guide sleeves 11, 13 when viewed in the axial direction. A housing fuel supply line 21 is also correspondingly provided in the valve housing 3. At the upper end section of the valve needle 9 a spring plate 23 is attached to this. A nozzle spring 25 presses against this and is braced on the housing side, thereby tensioning the valve needle 9 in the closing direction. Above the upper guide sleeve 13 an outer assembly sleeve 27 is attached in the central hole of the valve housing 3. The outer assembly sleeve 27 has a sleeve collar 44 at its lower end and this rests on a ring-shaped contact surface 45 on the housing 3. The sleeve collar has an outer surface 46, which is assigned to an inner wall 47 of the housing 3. A sealing element 48 in the form of a sealing ring is inserted between the outer surface 46 and the inner wall 47. The sleeve collar 44 is welded tightly to the inner wall 47 with a ring-shaped circumferential weld seam 49. This creates a needle leadthrough through an opening in a sleeve base 29, the leadthrough being sealed as described below. In a partial section of the outer assembly sleeve 27 restricted in the axial direction its inner wall forms a narrow point described in more detail below with the outer wall of an inner assembly sleeve 31, which is in turn attached to the valve needle 9. Cylindrical metal bellows 33 are welded to the outer and inner assembly sleeves 27, 31, the valve needle 9 being guided outwards by said bellows. The metal bellows 33 serve to seal the fuel chamber 35 off hermetically from an unpressurized, air-filled intermediate space 36. The metal bellows 33 are preferably in the region of the opening on the sleeve base 29 and attached to a surface of the inner assembly sleeve 31, which is turned towards the sleeve base 29.

Using the metal bellows 33 in the needle leadthrough allows the high-pressure area in the chamber 35 of the injection valve 1 to be sealed off totally, permanently and reliably from the intermediate space 36 with the drive area (not shown). Despite a low level of wall thickness of for example 50 to 500 μm the metal bellows 33 can withstand very high pressures due to their very high level of radial rigidity, without suffering irreversible deformation. The metal bellows 33 can also be designed so that high mechanical flexibility, i.e. a small spring constant in the direction of movement of the valve needle or the axial direction, is achieved. This means that deflection of the valve needle 9 is not impaired and that the forces induced in the valve needle due to length changes in the needle leadthrough caused by temperature are kept as small as possible. Furthermore the use of the metal bellows 33 in the needle leadthrough means that fuel leakage can be prevented with a high level of reliability.

The needle leadthrough sealed with the metal bellows in the outer assembly sleeve 27 can also be configured so that the forces caused by pressure and acting on the valve needle 9 mutually offset each other. This means that the valve needle 9 is generally kept pressure-free. For this the hydraulically effective diameter of the metal bellows is selected so that it corresponds exactly to the diameter of the valve seat 16 (not shown). As a result the pressure force triggered by the pressurized fuel acting on the valve needle 9 and the valve disk 15 and the force induced due to pressure by the metal bellows 33 in the valve needle mutually offset each other. This means there is no pressure force component acting on the valve needle 9 as a result. This ensures that the injection valve 1 exhibits a switching response which is almost completely independent of the fuel pressure, as the opening and closing forces are only determined by the actuator element, for example by piezo-actuators pretensioned in a spring tube, and the force of the pretensioned nozzle spring 25. The metal bellows 33 also have a broad operating temperature range with the same level of functionality due to their metal material. Even thermal length changes in the metal bellows 33 only result in negligibly small changes of force at the valve needle 9 in the axial direction due to the low level of axial spring constant of the metal bellows. The metal bellows can also partially or wholly replace the nozzle spring 25 due to their mechanical spring effect in the axial direction.

The outer sleeve housing 27 is configured according to FIG. 1*a* so that it creates a narrow and as long as possible a clearance fit with the inner assembly sleeve 31. The clearance here is only a few μm. The throttle effect of this long cylindrical fit means that rapid pressure changes in the fuel chamber 35 are kept away from the metal bellows 33, while static pressures can act unhindered on the bellows wall. Also the pressure waves in the region of the cross-section change of the first throttle point 37 are reflected off the chamber wall section perpendicular to the axial direction or the front face of the sleeve, so that only a pressure wave with a greatly reduced pressure amplitude continues into the ring-shaped gap created by the first throttle point 37.

Figure 2:
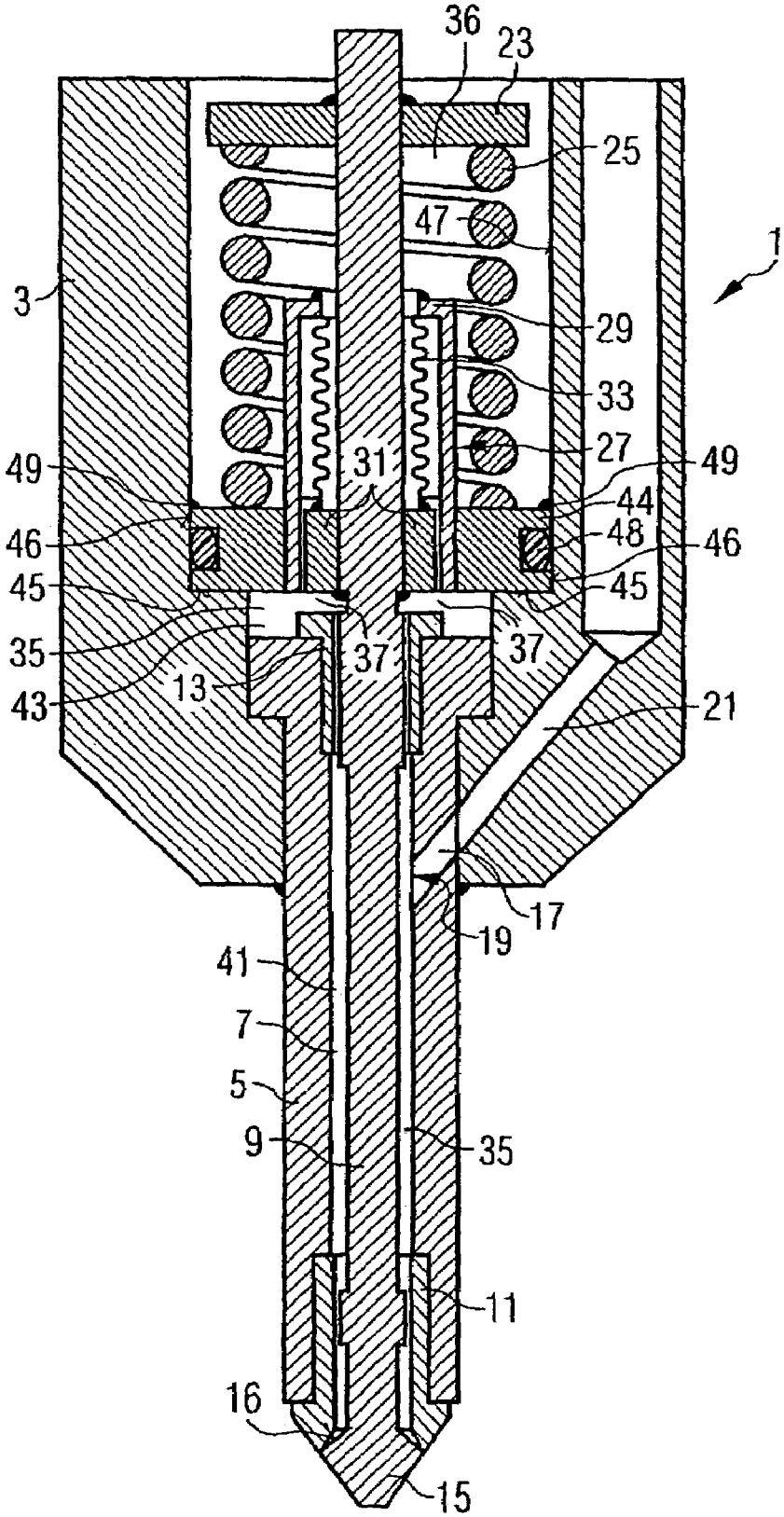

With a fuel injection valve 1 according to the second embodiment only one modification is made in FIG. 2 in the region of the first throttle point 37 compared with the valve 1 according to the first embodiment, to the effect that the free internal diameter of the sleeve collar 44 of the outer assembly sleeve 27 is reduced for the same throttle gap dimensions in favor of the external diameter of the inner assembly sleeve 31. As in the valve according to the first embodiment the throttle gap between inner and outer assembly sleeves 27, 31 is selected to be so small and long that an adequate throttle effect is achieved. The pressure waves triggered during the opening and closing of the valve 1 in the fuel chamber 35 cannot or can only slightly impact on the metal bellows 33 due to the short distance between the inner and outer assembly sleeves 27, 31.

Figure 3A:
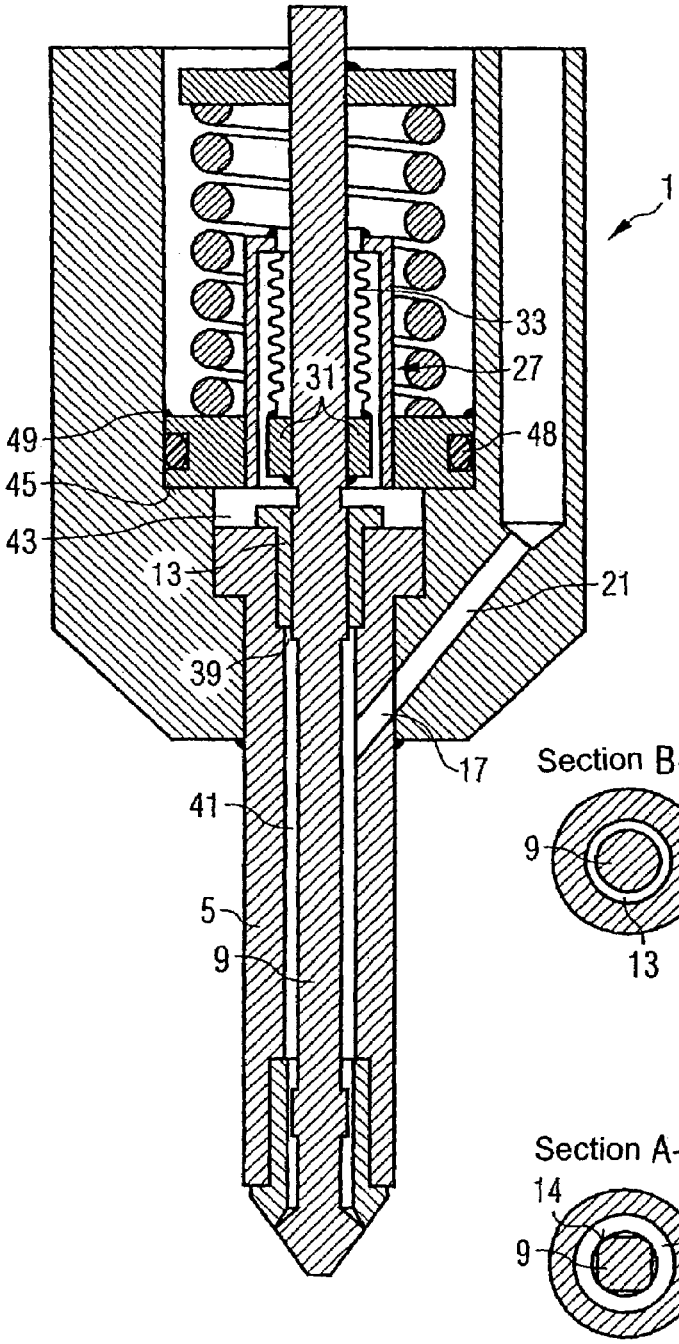
Figure 3B:
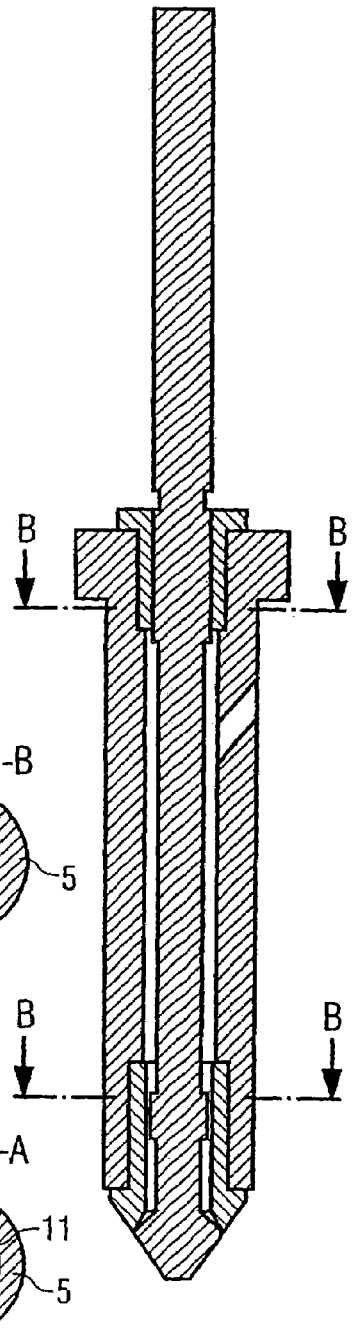
Figure 3B:
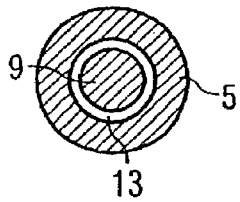
Figure 3B:
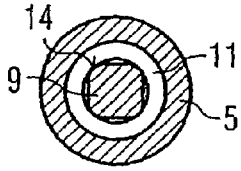

A fuel injection valve 1 according to the third embodiment shown in FIGS. 3*a, b* has a second throttle point 39 in the region of the upper valve needle guide or the upper guide sleeve 13 as an alternative in place of the first throttle point according to the first two embodiments. As the fuel supply line 17 opens below the upper valve needle guide 13 into the space between the valve needle 9 and the valve body 5 or the fuel chamber 35, the fuel to be injected into this does not have to pass the upper valve needle guide 13. Therefore the upper valve needle guide can even be configured as a narrow, long cylindrical clearance fit of the valve needle 9 in the upper guide sleeve 13, as shown in section B—B in FIG. 3*b*. Unlike the lower valve needle guide (section A—A) the valve needle 9 here is not configured as a square but is cylindrical (section B—B). The pressure waves triggered during opening and closing processes are reflected off this second throttle point 39 and a dynamic volume exchange is throttled significantly in the direction of the metal bellows 33. Integration of the throttle point 39 in the valve needle guide means that multifits can be avoided. The throttle effect of the upper valve needle guide 13 splits the fuel chamber 35 into two sub-volumes, namely a first and a second chamber sub-volume 41, 43. Although dynamic pressure changes of great amplitude are generated in the lower first sub-volume 41 of the fuel chamber 35 by the opening and closing of the injection nozzle, the action of these in the upper second sub-volume 43 of the fuel chamber 35, where the metal bellows needle leadthrough is located, can be greatly reduced by the dynamic sealing effect of the second throttle point 39. The metal bellows 33 are protected from dynamic pressure changes as a result.

Figure 1B:
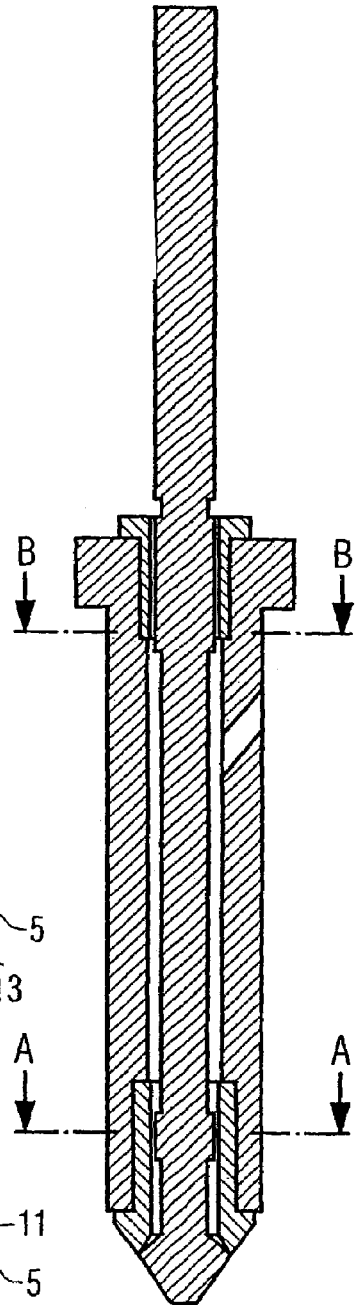

According to the fourth embodiment of a fuel injection valve (not shown) the throttle points 37, 39 shown in FIGS. 1 or 2 and 3 are combined in one valve. The first throttle point 37 is created by the inner and outer assembly sleeves 27, 31 and the second throttle point 39 is created by the upper guide sleeve 13 or the upper valve needle guide.

In the embodiments disclosed bellows in the form of a metal bellows were disclosed as a flexible leadthrough element. The invention is however not limited to this type of flexible leadthrough element but can also be used with other types of flexible leadthrough elements such as for example a diaphragm or a flexible plastic or rubber sleeve. The diaphragm is preferably made of metal. The diaphragm and the sleeve are stuck or welded in the same way as the disclosed metal bellows to the inner and outer assembly sleeve 27, 31.

In general the pressure in the second chamber sub-volume 43 can be adjusted by appropriate selection of the diameter of the clearance fit of the valve needle 9 in relation to the hydraulically effective diameter of the metal bellows 33. Adjusting the diameter of the clearance fit to be bigger (or smaller) than the hydraulically effective diameter of the metal bellows 33 means that the pressure in the second chamber sub-volume 43 drops (or increases) when the injection valve is opened. It is particularly advantageous if the diameter of the clearance fit corresponds to the hydraulically effective diameter of the metal bellows 33, because in this way the pressure in the second chamber sub-volume 43 remains essentially constant when the injection valve is opened; the metal bellows 33 are then only exposed to a constant pressure load in all operating states.

The invention claimed is:

1. A liquid dosing device for a pressurized fluid comprising:

a chamber located in a housing, to which the pressurized liquid is guided through a liquid supply line, a valve needle guided through the chamber, wherein a stroke can be applied to a first end section thereof outside of the chamber and the second end section thereof forming, in conjunction with a valve seat disposed on the housing, a valve which is connected to the chamber, and a flexible leadthrough element for the first end section of the valve needle from the chamber outwards, said element seals the chamber in a tight manner, at least one throttle point located circumferentially between the valve needle and the inner wall of the chamber in the section of the chamber between the leadthrough element and the mouth of the liquid supply line into the chamber, said throttle point comprising a gap.

2. A fluid dosing device according to claim 1, wherein metal bellows are provided as the leadthrough element.

3. A fluid dosing device according to claim 1, wherein the diameter of a clearance fit of the valve needle corresponds to a hydraulically effective diameter of the metal bellows.

4. A fluid dosing device according to claim 2, wherein the metal bellows have a wall thickness of 25 to 500 μm.

5. A fluid dosing device according to claim 1, wherein the leadthrough element is attached to an assembly sleeve by means of a welded connection.

6. A fluid dosing device according to claim 5, wherein the throttle point is created in the chamber by the assembly sleeve.

7. A fluid dosing device according to claim 1, wherein an upper valve needle guide is provided and the throttle point is created in the chamber by the upper valve needle guide.

8. A fluid dosing device according to claim 1, wherein the free cross-section between the valve needle and the inner wall of the chamber is changed abruptly in the region of the throttle point.

9. A fluid dosing device according to claim 2, wherein fuel is used as the liquid and the fuel pressure is in the range of between 1 and 500 bar.

10. A liquid dosing device for a pressurized fluid comprising:

a chamber located in a housing, to which the pressurized liquid is guided through a liquid supply line, a valve needle guided through the chamber having a first end section outside of the chamber and a second end section which forms in conjunction with a valve seat disposed on the housing a valve which is connected to the chamber, and a flexible leadthrough element being provided for the first end section of the valve needle, which seals the chamber in a tight manner, wherein at least one throttle point is provided circumferentially between the valve needle and the inner wall of the chamber in the section of the chamber between the leadthrough element and the mouth of the liquid supply line into the chamber, wherein the throttle point is formed by a gap.

11. A fluid dosing device according to claim 10, further comprising metal bellows as the leadthrough element.

12. A fluid dosing device according to claim 11, wherein the diameter of a clearance fit of the valve needle corresponds to a hydraulically effective diameter of the metal bellows.

13. A fluid dosing device according to claim 10, wherein the leadthrough element is attached to an assembly sleeve by means of a welded connection.

14. A fluid dosing device according to claim 13, wherein the throttle point is created in the chamber by the assembly sleeve.

15. A fluid dosing device according to claim 10, wherein an upper valve needle guide is provided and throttle point is created in the chamber by the upper valve needle guide.

16. A fluid dosing device according to claim 10, wherein the free cross-section between the valve needle and the inner wall of the chamber is changed abruptly in the region of the throttle point.

17. A fluid dosing device according to claim 10, wherein fuel is used as the liquid and the fuel pressure is in the range of between 1 and 500 bar.

* * * * *